US005306220A

United States Patent [19]

Kearney

[11] Patent Number: 5,306,220

[45] Date of Patent: Apr. 26, 1994

[54] KNOCK-DOWN WEIGHT-LIFTING FRAME AND EXERCISE SYSTEM

[76] Inventor: David E. Kearney, 3014 Lake Country La., Glencoe, Mo. 63038

[21] Appl. No.: 897,190

[22] Filed: Jun. 11, 1992

[51] Int. Cl.[5] ..... A63B 21/06

[52] U.S. Cl. ..... 482/94; 482/99; 482/104; 482/138; 482/142; 482/145

[58] Field of Search ..... 482/94, 97-104, 482/106, 133-138, 142-145, 908

[56] References Cited

U.S. PATENT DOCUMENTS

| | | | |
|---|---|---|---|
| 2,932,509 | 4/1960 | Zinkin . | |
| 3,625,511 | 12/1971 | Rennemann . | |
| 3,948,513 | 4/1976 | Pfotenhauer | 482/142 |
| 3,999,762 | 12/1976 | Castor . | |
| 4,262,901 | 4/1981 | Faust . | |
| 4,306,715 | 12/1981 | Sutherland | 482/104 |
| 4,337,942 | 7/1982 | Sidlinger . | |
| 4,615,524 | 10/1986 | Sutherland . | |
| 4,620,701 | 11/1986 | Mojden | 482/142 X |
| 4,635,930 | 1/1987 | Cormier | 482/104 |
| 4,635,934 | 1/1987 | Boethke | 482/104 |
| 4,637,608 | 1/1987 | Owens et al. | 482/142 X |
| 4,638,995 | 1/1987 | Wilson | 482/142 |
| 4,648,595 | 3/1987 | Selle | 482/104 |
| 4,655,448 | 4/1987 | Harder . | |
| 4,781,374 | 11/1988 | Lederman | 482/104 X |
| 4,784,384 | 11/1988 | Deola | 482/138 X |
| 4,789,152 | 12/1988 | Guerra | 482/142 |
| 4,799,673 | 1/1989 | Selle . | |
| 4,799,674 | 1/1989 | Ochab . | |
| 4,807,875 | 2/1989 | Tanski . | |
| 4,832,334 | 5/1989 | Mullen | 482/106 |
| 4,919,419 | 4/1990 | Houston | 482/138 |
| 4,928,961 | 5/1990 | Madden . | |
| 4,934,693 | 6/1990 | Santoro . | |
| 4,974,838 | 12/1990 | Sollenberger | 482/102 X |
| 4,974,839 | 12/1990 | Cantor . | |
| 5,018,727 | 5/1991 | Cornell . | |
| 5,042,800 | 8/1991 | Walter | 482/908 X |
| 5,082,259 | 1/1992 | Gonzalez | 482/142 X |
| 5,082,260 | 1/1992 | Dinelli | 482/104 |
| 5,160,305 | 11/1992 | Lin | 482/138 |

FOREIGN PATENT DOCUMENTS

| | | | |
|---|---|---|---|
| 2630652 | 11/1989 | France | 482/138 |

OTHER PUBLICATIONS

"VHP Quality Weightlifting Equipment" catalog, undated, VHP Inc., Sharon, Pa. 16146.

*Primary Examiner*—Robert Bahr

*Attorney, Agent, or Firm*—Shlesinger, Arkwright & Garvey

[57] ABSTRACT

A universal-use knock-down weight-lifting frame with vertically and horizontally adjustable members designed to work in parallel with a second adjustment frame. A main frame has front and rear spaced opposed ends, a front substantially vertical multifunction upright disposed at the front end of the main frame, and a member disposed at the front end of the main frame for varying the vertical length of the front multifunction upright. There is a front substantially horizontal support foot at the front end of the main frame, and an element disposed at the front end of the main frame for varying the horizontal length of the front support foot. A rear vertically adjustable substantially vertical multifunction upright is disposed at the rear end of the main frame, as well as a rear substantially horizontal leg of which the horizontal length can be varied.

22 Claims, 4 Drawing Sheets

KNOCK-DOWN WEIGHT-LIFTING FRAME AND EXERCISE SYSTEM

FIELD OF THE INVENTION

This invention relates to a universal, knock-down weight-lifting frame, and to an exercise system using the knock-down frame.

BACKGROUND OF THE INVENTION

Weight-lifting equipment is well known, and take-apart exercise equipment apparatus for use in the home or in a gym exists. However, known exercise apparatuses are generally bulky, complicated to assemble/-disassemble, uneconomical, time-consuming to adjust, and unsafe for weight lifters and other exercisers to use alone.

It is important that weight-lifting equipment be readily adjustable, because weight lifters must perform a variety of exercises in order to develop individual muscle groups. Given that muscle groups must be exercised on a daily basis, or on alternate days depending on the exercise schedule and the goals of the weight lifter, it is still further important that weight-lifting equipment be readily adapted to exercise different muscle groups so that the desired muscle development is achieved in a balanced and complimentary manner in a minimal amount of dedicated exercise related time. In addition, many weight lifters want the convenience of exercising at home because the commute from one's home to the gym can be eliminated, thereby freeing up more time to engage in exercises.

Known exercise equipment, however, is generally unsafe for use alone, and is relatively bulky, space consuming, and expensive, so that it is generally unavailable to the average individual.

A known bench press safety apparatus is disclosed in U.S. Pat. No. 4,799,673 to Selle. That device recognizes the goal of a safe piece of exercise equipment for use by a solo weight-lifter in the home, yet still has the drawbacks of being complicated, suited only to one function, and difficult to adjust for accommodating different user's requirements.

OBJECTS AND SUMMARY OF THE INVENTION

A primary object of the invention is to provide a portable, universal weight-lifting frame having vertically and horizontally adjustable members.

A further object of the invention is to provide a universal, knock-down weight-lifting frame, and safety bar which in and of itself provides for a protected or safe means of barbell related weight lifting, and to which modular attachments when used in conjunction with the basic frame(s) allow for the simple configuration of an extensive array of related exercise equipment.

Another object of the invention is to provide a weight-lifting frame upon which auxiliary or modular pieces of weight-lifting equipment can be readily integrated to provide additional weight-lifting configurations or exercises which further develop particular muscles.

Yet another object of the invention is to provide a weight-lifting frame which can be used independently of existing weight-lifting systems.

Still another object of the invention is to provide a weight-lifting frame which increases the safety of a weight lifter using free weights, even if the user drops a free weight while exercising alone.

It is a still further object to provide a piece of weight-lifting equipment which can be readily assembled and substantially disassembled into small discrete components, without tools, and which is sufficiently portable so that it can be carried in the back seat or in the trunk of a standard automobile, or stored when minimal space is available such as in an apartment or place such as a garage which has other demands or functions.

Yet another further object of the invention is to provide a weight-lifting frame which can be attached to an existing weight-lifting system, thereby providing a desired safety element and increased usability not originally designed into the original system.

A still further object of the invention is to provide a weight-lifting system to which additional components can be added as desired for additional muscle development, variation of exercise routine, and as a user's budget allows.

Still another object of the invention is to provide a weight-lifting frame and apparatus which can be used with existing bench and rack apparatuses.

A still further object of the invention is to increase the safety of exercising with free weights, such as weighted barbells, while allowing for a use of free weights at a variety of angles, thereby exercising and developing different muscle groups effectively.

It is yet another object of the invention to provide a weight-lifting frame which is vertically adjustable in a variety of increments for accommodating any height or size of the user while permitting a large number of weight-lifting and other related exercises wherein equipment is adjustable to fit the individual's body build and size.

A further object of the invention is to provide a weight-lifting frame having one or more multifunction uprights attachable to a variety of pieces of auxiliary equipment including a lat hold-down member, an exercise bench, a cable crossover, various leg hold devices, a fixed or adjustable seat, and a safety support bar for catching a dropped barbell and other devices as can be readily designed and adapted to serve as attachments thereby.

It is a still further object of the invention to provide a weight-lifting frame having no attachments to the floor or ceiling, so that the weight-lifting frame can be used at or on any essentially level location with sufficient support to accommodate the equipment and weights yet without special attachments or other devices.

Another object of the invention is to provide a weight-lifting frame having supporting feet which provide lateral support of parallel frames, allow interconnection of the parallel frames, and permit width adjustment owing to the cross connecting members.

It is yet another object of the invention to provide a slip-on bar holder for a bench press that doubles as a leg holder, seat back support or pad support in different configurations when the weight-lifting frame system is used independently.

It is another object of the invention to provide an upper, load-bearing safety support bar having a construction which is engineered to minimize binding, and provide easy gliding movement of the components, while increasing the structural integrity because the load applied to the frame is carried externally on the outside of the taller multifunction upright and by the inside of the shorter one of the multifunction uprights.

It is a yet further object to provide a shock-absorbing member such as hard rubber or plastic on an upper surface of the upper safety support bar that absorbs shock and reduces the distracting and fatiguing noise associated with dropped free weights.

In summary, the present invention provides a portable or universal weight-lifting frame having vertically and horizontally adjustable members, comprising a main frame having front and rear spaced opposed ends, a front substantially vertical multifunction upright disposed at the front end of the main frame, and means disposed at said front end of said main frame for varying the vertical length of the front multifunction upright. There is a front substantially horizontal support foot disposed at the front end of the main frame, means disposed at the front end of the main frame for varying the horizontal length of the front support foot, and a rear substantially vertical multifunction upright disposed at said rear end of the main frame. Also, there is a means disposed at the rear end of the main frame for varying the vertical length of the rear multifunction upright, a rear substantially horizontal leg disposed at the rear end of the main frame, and means disposed at the rear end of the main frame for varying the horizontal length of the rear support foot.

DETAILED DESCRIPTION OF THE PREFERRED EMBODIMENTS

Figure 1:
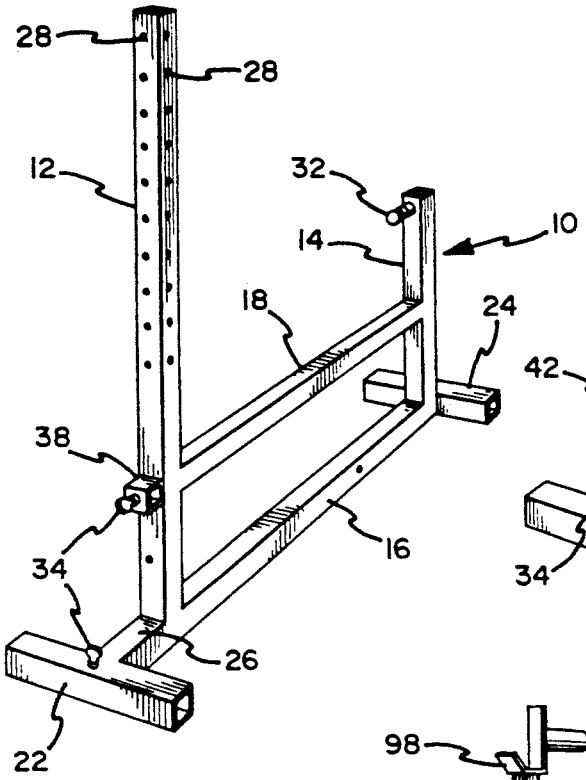
FIG. 1 is a perspective view showing a universal, knock-down weight-lifting frame according to the invention.

As shown in FIG. 1, a substantially planar, rigid main frame 10, which is a basic component of the universal, knock-down weight-lifting and exercise frame according to a preferred embodiment of the invention, includes a front multifunction upright 12 and a spaced apart rear multifunction upright 14. A lower cross brace 16 integrally connects front upright 12 and rear upright 14. An optional upper cross brace 18 extends substantially parallel to lower cross brace 16 and integrally attaches front multifunction upright 12 to rear multifunction upright 14 for still further rigidity and stability.

A front element or substantially horizontal support foot 22 is a preferably integrally attached to lower cross brace 16 at a lowermost portion of the front thereof, and a rear element or substantially horizontal support foot 24 is integrally preferably attached to a lowermost portion of the rear end thereof. An extension 26 is preferably provided front support foot 22 and a lower end of front multifunction upright 12. Throughholes 28 are provided on at least one side and preferably on all sides of multifunction upright 12. A self-locking, spring-loaded, quick-release pin 32 is provided in at least one face of the rear upright 14. A threaded tightening member or like fastener 34 is disposed in at least one face of each one of front support foot 22 and rear support foot 24, respectively. Quick release pin 32 or tightening member 34 can be used in rear support foot 24. An accessory attachment member 38 is attached to one face of front upright 12, preferably above extension 26, and preferably includes fastener 34.

Figure 2:
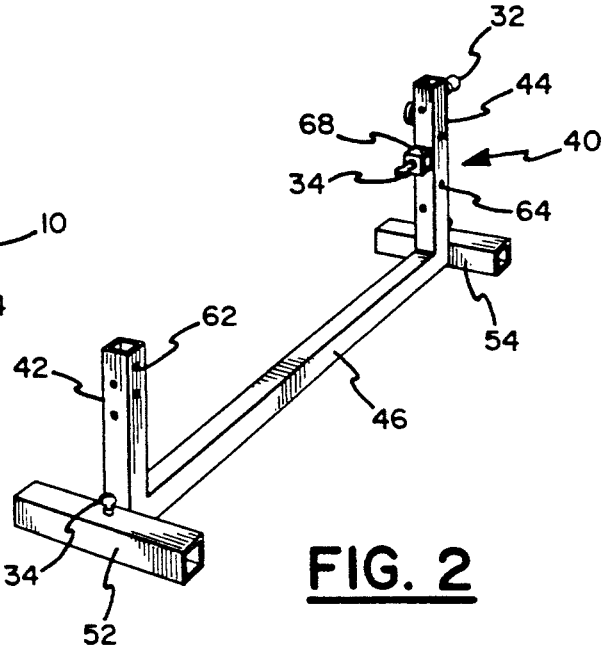
FIG. 2 is a perspective view similar to FIG. 1 of another embodiment of the weight-lifting frame according to the invention.

FIG. 2 shows another preferred embodiment of the invention in which a main frame 40 includes a rear multifunction upright 42, a front multifunction upright 44, a lower cross brace 46 integrally attaching the rear and front multifunction uprights 42 and 44 along with transversely extending rear and front support feet 52 and 54, respectively. Main frame 40 likewise has rear throughholes 62 in rear upright 42, and front throughholes 64 in front multifunction upright 44. The manner in which rear throughholes 62 and front throughholes 64 cooperate with other elements to vary the length of rear upright 42 and front upright 44 will be even more apparent after considering the description of FIG. 5 below. An accessory attachment member 68 is preferably attached to an inner face of front multifunction upright 44. As required, quick-release pin 32 is provided on front upright 44.

Figure 3:
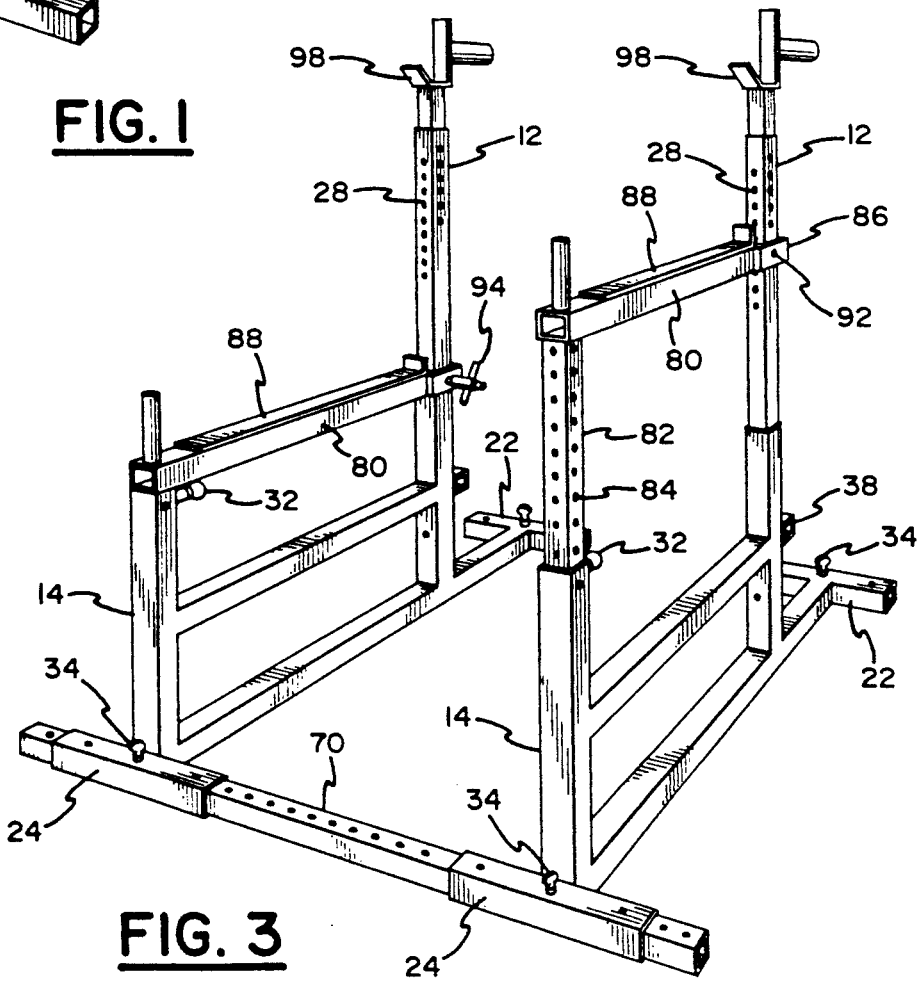
FIG. 3 is a rear perspective view of a knock-down weight-lifting apparatus according to the invention in which two main frames are disposed side by side in a horizontally adjustable relationship.

Turning to FIG. 3, a pair of substantially identical main frames 10 is shown as viewed from the rear. Main frames 10 are rigidly held together in the spaced apart position shown by an auxiliary support foot or horizontal submember 70 which is secured by tightening screw 34 located in front and rear support feet 22 and 24. Tightening screws 34 prevent movement of rear support foot 24 relative to horizontal submember 70. An additional submember 70 (not shown) can be inserted through front support feet 22 of main frames 10 for additional stability.

Although front support foot 22 and rear support foot 24, as well as horizontal submember 70 can be made from materials having circular cross sections, each of these components preferably has a mating square cross section so that even if a user fails to pin or lock support foot 24 and submember 70 together, by tightening screw 34 for example, submember 70 will be unable to rotate about its longitudinal axis. Thus, if a user steps on an unpinned square cross section 70, it will not rotate, causing the user to slip and fall. A vertically adjustable safety support bar 80 is disposed for vertical movement relative to main frame 10. Safety support bar 80 includes a downwardly extending vertical extension or submember 82 having throughholes 84 defined therein, and an open tubular member 86 attached at an end distant from the end at which extension 82 is attached. Rear multifunction upright 14 is preferably a square tube, which may be a commercially available steel tube, and which receives and is configured to mate with rear extension 82 which, likewise, preferably has a square cross section.

A shock absorbing member 88, such as a plastic or hard rubber pad, is preferably disposed on a top surface of safety support bar 80 for absorbing some of the impact of a dropped free weight and for lessening the noise made by the dropping of a weight (not shown). At least one throughhole 92 is provided in open tubular member 86 so that a quick-release coupling element, a straight pin or a j-pin 94 can be inserted therethrough, for preventing relative movement between front upright 12 and open tubular member 86.

In a similar fashion, quick-release coupling element or pin 32 is inserted through throughholes 84 and predetermined ones of throughholes 84 of submember 82 for preventing relative movement between safety support bar 80 and main frame 10. A handle 89 at one end of safety support bar 80 prevents a barbell from rolling off said support bar and provides a hand-hold for a weight lifter to use in conjunction with other exercises not herein described. A cradle 98 may be detachably placed on an upper end of vertical multifunction upright 12 for receiving a weight-lifting bar when not in use. Support extension 99 may be constructed of such dimensions so as to slip inside of upright 12, as depicted FIG. 3, or alternatively, for an alternative support extension 99' to be attached to the back plate of a slip-on cradle 98' and to be of suffient hollow-tube dimensions so as to slip over upright 12. Both embodiments are height adjustable and secured by inserting a quick release pin through hole 28 of respective engaged extensions 99 and 99' and upright 12.

Figure 4A:
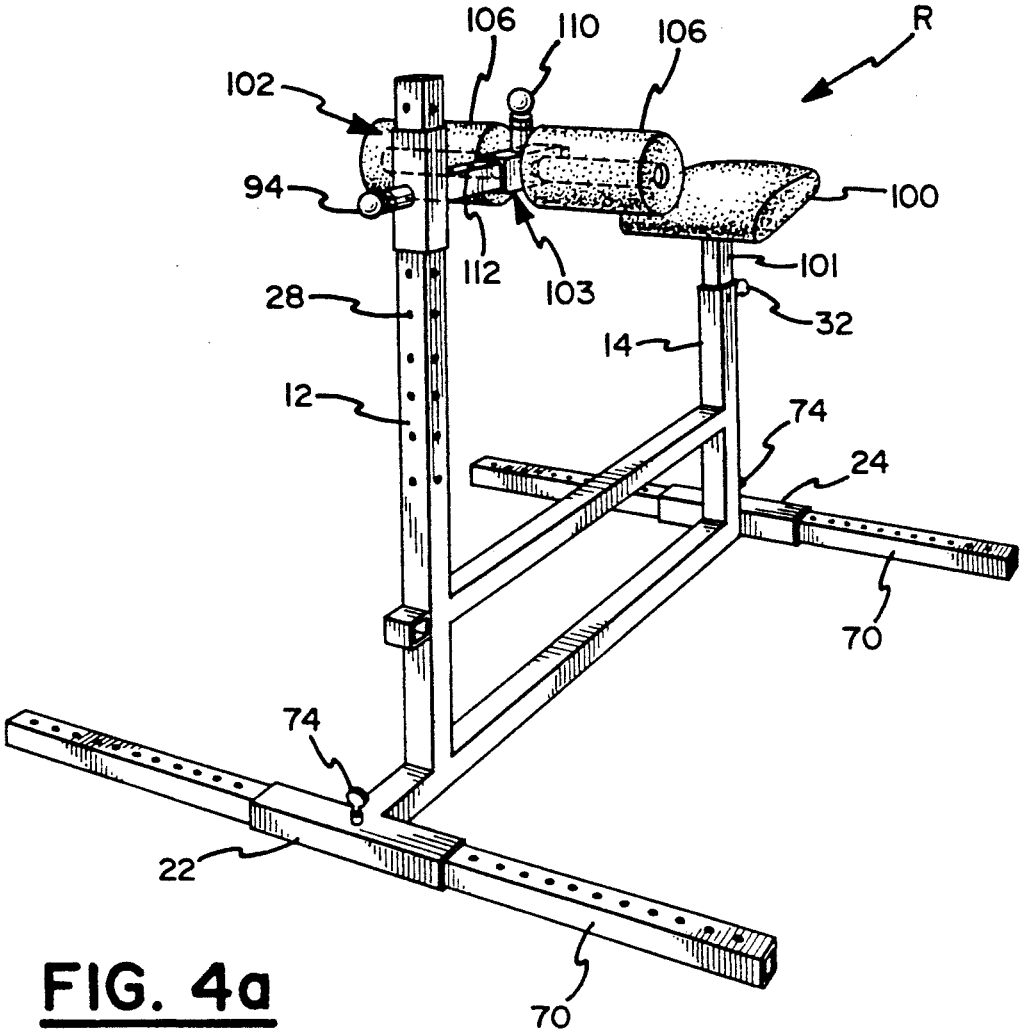
FIG. 4A is a front perspective view showing the weight-lifting frame according to the present invention to which an auxiliary seat and leg hold have been added for performing various exercises.

Turning to FIG. 4A, a combination Roman chair/-hyperextension device R is shown constructed using main frame 10 according to the invention, as viewed from the front. The Roman chair R includes a seat 100 and seat support 101 attached to rear multifunction upright 14 and fixed relative thereto by self-locking pin 32. A leg hold 102 has a pad support 103 which is provided with an attachment member 104 supporting pads 106 for engaging an exerciser's legs. Attachment member 104 has a quick-release pin 94 for fixing leg hold 102 relative to front multifunction upright 12.

The horizontal distance between leg or foot supporting pads 106 and seat 100 can be fixedly varied by releasing and inserting a quick-release pin 110 through a selected one of holes 112 formed in leg hold 102 in a manner similar to the interengagement of pin 94 and throughholes 28, as will be readily understood. Similarly, the vertical distance between leg hold 102 and seat 100 can likewise be adjusted to accommodate feet or ankles.

Figure 4B:
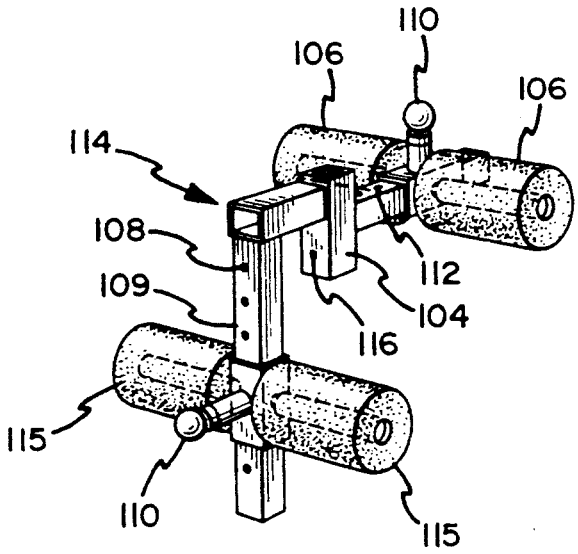
FIG. 4B is a front perspective view showing a preferred embodiment of a leg or foot hold according to the invention.

For added stability of the Roman chair R according to the invention, horizontal submembers 70 can be inserted through respective front and rear support feet 22 and 24, and detachably pinned together by tightening screws 34 or the like. FIG. 4B shows another embodiment of a foot hold 114 having adjustably located pad 106 as well as a second adjustably movable pad 115 disposed at an angle relative to pad 106. Holes 108 in an extension 109 receive self-locking pin 110 for adjustment of the location of pads 115. At least one hole 116 is provided in attachment member 104 and through which a locking pin (not shown) can be inserted for fixedly adjusting the position of member 104 relative to upright 12, as will be readily apparent. A further quick-release pin 110 or other fastener can likewise be disposed at the location of hole 116, if desired.

Figure 5:
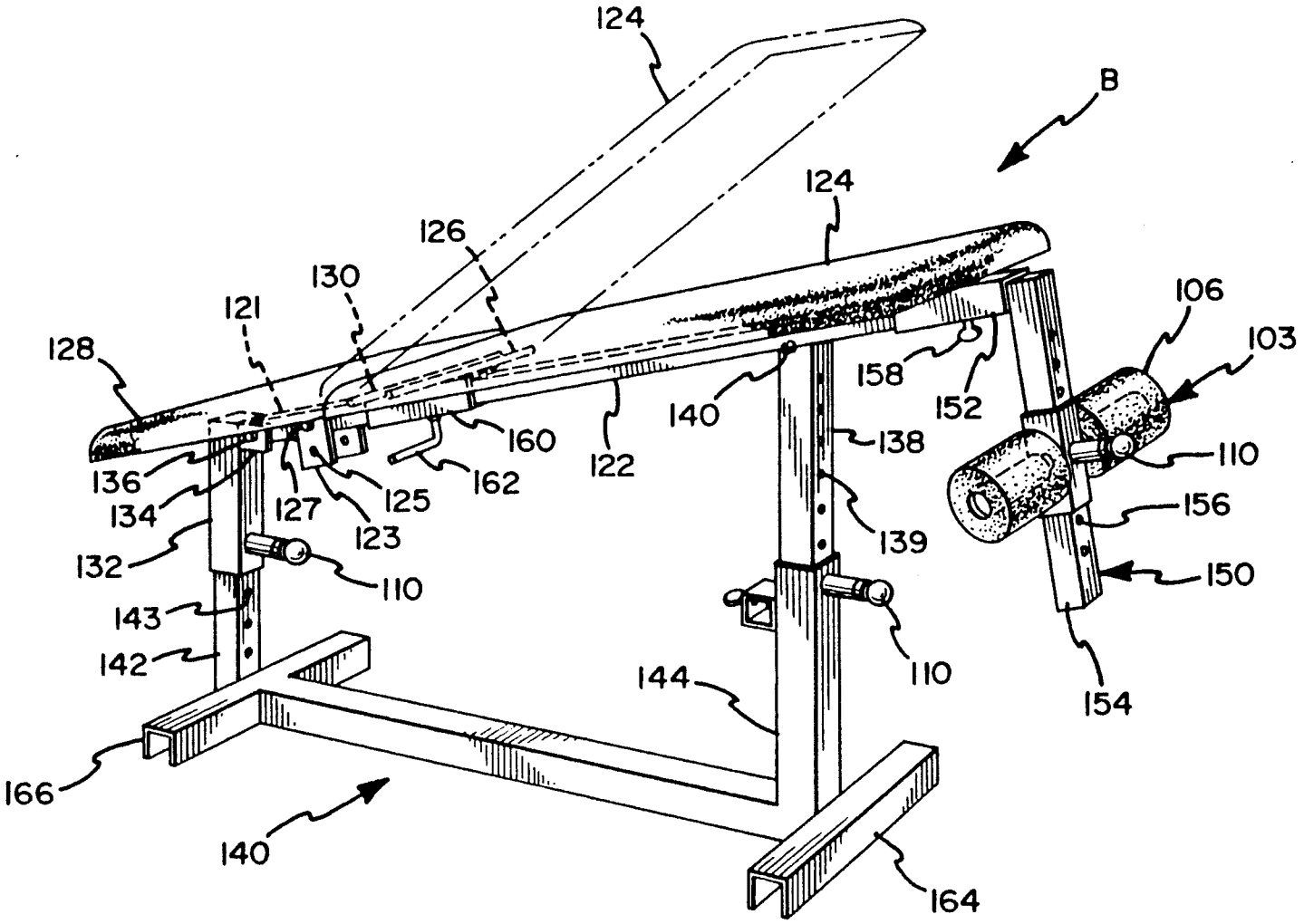
FIG. 5 is a perspective view of the weight-lifting frame according to the invention to which an auxiliary angularly adjustable bench and leg lift has been added.

An adjustable bench B according to the invention is shown in FIG. 5. Bench B includes a main support beam 122 relative to which a front cushion or pad 124 is pivotable by means of a pivot pin 126. A further rear cushion or pad 128 is pivotable relative to main support beam 122 by means of a pivot pin 130. A rear leg 132 has ears 134 attached at an upper end thereof, and is pinned to main support beam 122 at pivot joint 136. Pivot joint 136 may be a fixed pivot, a quick release pin, or a nut and bolt combination for affording complete disassembly of bench B. A front leg 138 is pivotably attached at joint 140 (shown schematically for clarity) which may likewise be a nut and bolt or other quick-release type pin connection.

A further embodiment of a main frame 140 is preferably provided as will be explained in detail below. Main frame 140 has a rear multifunction upright 142 with holes 143 and a front multifunction upright 144 having quick-release pin 110. Front leg 138 is slidably receivable in front upright 144 of main frame 140 and has throughholes 139 into which pin 110 disposed on front upright 144 may be inserted for fixing front leg 138 relative to front upright 144. Seating sections 128 and 124 are pivotably attached to a slide 160 which slips over/around main support beam 122.

A rear support beam 121 is attached to pivot joint 136, such as a bolt and self tightening nut, and rear support beam 121 slides inside of support beam 122 so that the relative movement of front support beam 122 and rear support beam 121 adjusts the overall support frame length, as required, when fine-tuning the heights of rear leg 132 and front leg 138. It is desirable to provide for angular adjustment of rear pad 128 relative to rear support beam 121. Accordingly, an extension 123 having adjustment holes 125 is attached to the bottom of rear pad 128. By selectively locating a seat fastener 127 in an appropriate one of holes 125, and a corresponding hole (not shown) in rear support beam 121, as will be readily understood, extension 123 is moved relative to beam 121 and, hence, rear pad 128 is rotated about pivot pin 130 to the desired angle.

In a similar fashion, self-locking pin 110 is inserted into throughholes 143 of rear upright 142 and prevents relative movement between rear leg 132 and rear multifunction upright 142.

At the front end of bench B an L-shaped extension 150 is attached to main support beam 122 by means of a first leg 152 removably inserted into support beam 122. A second leg 154 of L-shaped extension 150 extends substantially transversely to first leg 152. Throughholes 156 are formed in second leg 154, whereby pads 106 (FIG. 4) are removably attached to second leg 154 by the engagement of pin 110 With throughholes 156.

A fastening member or tightener 158 is disposed at the front end of bench B for releasably attaching L-shaped extension 150 to main support beam 122. The length of first leg 152 is sufficiently long so that the distance between second leg 154 (and, hence, pads 106) and main support beam 122 can be widely varied. L-shaped extension 150 can also accommodate leg hold 114 of FIG. 4B, in which case pad 115 provides an adjustable back of the knee support and pad 106 provides an adjustable foot/ankle support. Likewise, a seat slide 160 attached to rear pad 128 and to front pad 124 allows movement of the front and rear pads relative to main support beam 122, a slide stop or tightener 162 being provided for detachably fixing seat slide 160 to main support beam 122. Seat slide 160 and tightener 162 are preferably completely detachable from main support beam 122, so that the entire knock-down weight-lifting frame, and in this particular use as bench B, can be disassembled completely for storage in a small space.

Preferably, main frame 140 for use with bench B has a front support foot 164 and a rear support foot 166, both of which are made of C-shaped channels or pairs of angle irons welded together to form C-shaped channels, instead of the square tubes preferably used for feet 52 and 54 of the embodiment of FIG. 2. C-shaped support feet 164 and 166 allow for the exercise equipment set-up of FIG. 5 to be easily slipped over cross-connecting members 70 (FIG. 3) so as to position and secure the exercise device of FIG. 5 between and parallel to main frame(s) 10 as configured in FIG. 3.

Figure 6:
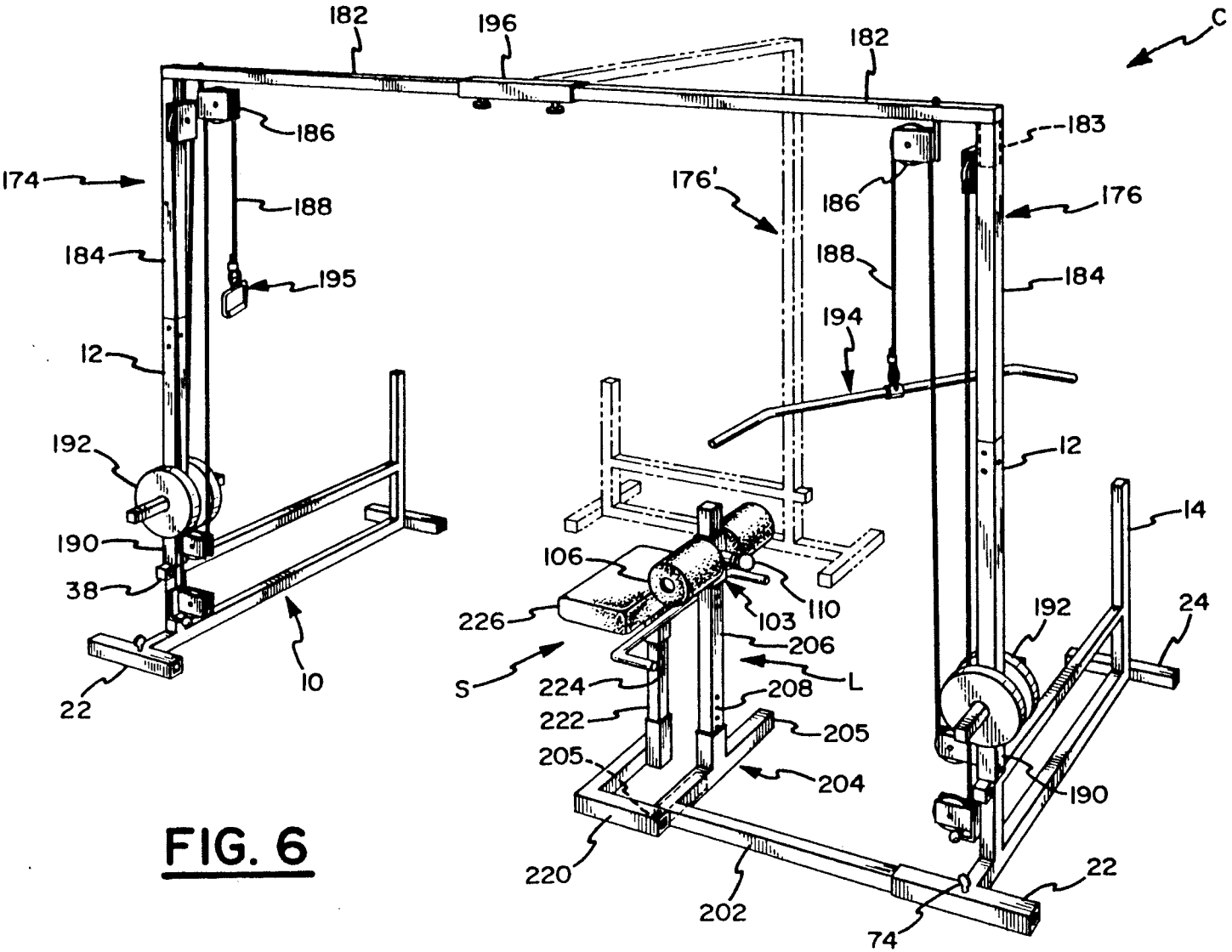
FIG. 6 is a perspective view of two weight-lifting frames according to the invention to which a piece of auxiliary cable crossover equipment has been added, an alternative arrangement of the cable crossover equipment being shown in phantom line, and to which auxiliary leg support and seat support equipment has been added.

FIG. 6 shows an additional use of the knock-down weight-lifting apparatus as a cable crossover C. Cable crossover C is shown in a standard, 180° set-up with an optional 90° set-up shown in phantom line. Cable crossover C has two halves, left half 174 and right half 176, each of which includes a substantially horizontal leg 182 with an extension 183 for connecting removably attached downwardly extending vertical leg 184. Vertical leg 184 is removably attached to vertical upright 12 (FIG. 1) by extension 185 which is affixed within and extends beyond the lower end of vertical leg 184 in such fashion and of appropriate dimension so that member 185 slips inside of and engages member 184 so as to cause member 184 to be flush with and a continuing extension of upright 12. A plurality of pulleys 186 are configured so that a swivel pulley **186*a* is affixed to horizontal leg 182, a pulley 186*b* is affixed to vertical leg 184, a pulley 186*c* is affixed to slidable weight guide 190 and a swivel pulley 186*d* is removably attached to the base of vertical upright 12 by throughpin and insertion of an extension flange, which is affixed to pulley 186*d* and engages and is secured by accessory attachment 38. A separate cable 188 is threaded, according to known and accepted industry technology through each of pulleys 186*a*, 186*b*, 186*c*, and 186*d*, essentially as depicted in FIG. 6 so that when cable 188 is pulled from and through either its top pulley 186*a* or bottom pulley 186*d* pulley position, slidable weight guide 190 is caused to slide vertically along upright members 12 and 184**.

Weights or known force resisting members 192 are attached to slidable weight guide 190 and are lifted vertically along upright members 12 and 184 by pulling on a two-handed handle 194 which is removably attached to the desired end of cable 188. For exercises involving one hand, a one-handed handle 195 can be substituted for handle 194, as shown in the left side of FIG. 6. A rigid coupling attaches free ends of identical horizontal legs 182, and is a straight coupling 196 (FIG. 7) or an L-shaped rigid coupling 196' (FIG. 8), the choice of coupling being determined by the manner in which cable crossover C is setup.

FIG. 6 also shows a lat hold-down L having a main leg 202, a side leg 204 extending transversely to main leg 202, and a vertical accessory post 206 integrally attached to side leg 204 and extending substantially transversely to both side leg 204 and main leg 202. Side leg 204 has open ends 205 for receiving accessories such as a seat support described below. Lat hold-down L is fixedly pinned to front support foot 22 by means of fastener 34. Throughholes 208 defined in accessory post 206 allow for leg hold 103 having pads 106 to be vertically fixedly adjusted by the use of quick-release pin 110.

FIG. 6 further illustrates a seat support s having a substantially U-shaped base 220 and a seat-supporting upright 222. Upright 222 includes holes 224 and adjustably supports a seat 226 for vertical movement relative to base 220 by means of selectively placing a pin through a desired one of holes 224 in a manner similar to the vertical adjustment of leg hold 103 relative to side leg 204 in lat hold-down L. Seat 226 can likewise be adjusted transversely relative to pads 106, or relative to handle 194, for example, by sliding U-shaped base 220 relative to side leg 204.

OPERATION

In use, a weight lifter or exerciser takes one or more of each of the components and assembles a weight-lifting or exercise set-up dependent on the workout to be performed.

For example, if a weight lifter want to bench press a weighted barbell, then he or she takes a pair of main frames 10, sets them up at a desired spacing, and slides horizontal submember 70 through respective rear support feet 24, such as shown in FIG. 3. Then, the weight lifter inserts extension 82 into multifunction upright 14 while slipping open tubular member 86 around front multifunction upright 12.

The weight lifter slides safety support bar 80 upwardly to the desired vertical height relative to the floor on which front and rear support feet 22 and 24 are resting, and fixes safety support bar 80 relative to main frame 10 by means of j-pin 94. Cradles 98 are placed on the top ends of respective multifunction uprights 12 and 14, and a free weight such as a barbell (not shown) is placed on cradles 98. A bench such as shown in FIG. 5 or some other conventional bench is then placed between the parallel frame and bench press exercises can be safely executed.

If a free standing military press, or squats, are to be performed, the weight lifter simply removes the bench and steps between the frames 10 and performs the exercise by grabbing and raising the free weight resting on cradles 98. Should the free weight be dropped, or should the weight lifter otherwise be unable to complete the exercise safely, such as by placing the free weight back in its place on cradle 98, the weight lifter can safely drop the free weight onto safety support bars 80. The rubber pads 88 of support bars 80 soften the blow and reduce the clanging noise normally associated with dropped weights, thereby increasing the pleasure of using free weights, and concurrently increasing the safety of using free weights by reducing extraneous and irritating noise which distracts and fatigues the users of conventional weight-lifting equipment.

If a bench press is to be performed, then a pair of rigid main frames is set up as described immediately above, and bench B as shown in FIG. 5 is inserted between the two rigid main frames 10. The vertical height of safety support bars 80 is adjusted relative to upper surfaces of front pad 124 and rear pad 128, and the weight lifter lies or sits on one or both of front pad 124 or rear pad 128 and exercises accordingly.

In order to exercise the most varied and the largest number of muscle groups, bench B is independently vertically adjustable at both its rear leg 132 and front leg 138 relative to rear upright 142 and front upright 144, respectively. In this manner, the angle of pads 124 and 128 relative to the horizontal can be widely varied for allowing a weight lifter to perform any number of desired exercises.

To further enhance the variability of exercises possible with the weight-lifting apparatus according to the present invention, front pad 124 and rear pad 128 are each independently pivotably attached to slide 160, which is slipped over main support beam 122, for rotation relative to main support beam 122, and hence, the free weights supported on cradles 98 of the main frames 10 when in use. Thus, a virtually infinite number of angles of front pad 124 and rear pad 128 relative to the main frames 10, and hence, relative to the free weights being used, is possible. Such a wide variation allows the weight lifter the required subtle changes of angles necessary to optimally exercise discrete muscle groups. Not only are desired muscle groups exercised, but each muscle group can be safely and correctly strained. To support front pad 124 in its angled position as shown in phantom line in FIG. 5, the user can place a pair of main frames 10 as shown in FIG. 3 with a bar supported by cradles 98 serving to hold front pad 124 at the desired angle. To adjust the angle of front pad 124, the user simply lowers cradles 98, and, hence the free end of front pad 124 (i.e., the right end of pad 124 as viewed in FIG. 5).

When the weight lifter or exerciser wishes to perform hyperextensions or sit-ups in so-called Roman chair R, then one main frame 10 is provided with seat 100, seat support 101, and pads 106 as shown in FIG. 4A. The set-up can be readily assembled and disassembled, and seat 100 is vertically adjusted by use of pin 32, based on the requirement of the exercise to be performed, and on the size of the user. In a similar fashion, the vertical distance between the user and pads 106 can be adjusted by use of pin 94, and the horizontal distance between pads 106 and the weight lifter is varied by selective engagement of pin 110 in holes 112. Hence, it is possible for a weight lifter to fine-tune the relationship between pads 106 and seat 100, whereby an optimum distance between seat 100 and pads 106, at which point the user's legs or feet are held, is achieved.

Similarly, by substituting foot hold 114 of FIG. 4B for leg hold 102 of FIG. 4A, vertical adjustment for the feet and for the legs of the weight lifter is possible. One simply adjusts the position of attachment member 104 relative to upright 12, as well as the position of pads 115 relative to extension 109, and the position of pads 106 relative to attachment member 104. Accordingly, sit-ups and extensions can be safely performed while optimally straining the intended muscles.

Figure 7:
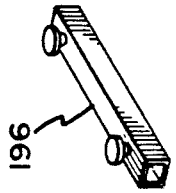
FIG. 7 is a perspective view of a coupling member used in the set-up of FIG. 6.

If a weight lifter desires to use cable crossover C, it can be set up in one of a couple ways as shown in FIG. 6. If sufficient room is available, cable crossover 0 can be set up with horizontal legs 182 of respective halves 174 and 176 of cable crossover C extending substantially 180° relative to each other by use of straight rigid coupling 196 (FIG. 7). Respective vertical legs 184 are attached to the free ends of horizontal legs 182 by extensions 183, which may be pinned together in a manner similar to other pin joints and quick-release pins according to the invention as will be apparent to one skilled in the art. Vertical legs 184 are attached to legs 182 at one end thereof, and attached to multipurpose uprights 12 of main frames 10 at the other end thereof.

Cable 188 is threaded through pulleys 186, weights 192 are attached to a lower free end of cable 188 (lower right as viewed in FIG. 6), and handle 194 is attached to the other free end of cable 188. The weight lifter can either stand or sit while pulling handle 194 toward and away from himself, or, lat hold-down L can be used in conjunction with cable crossover C. For one-handed exercises, handle 195 is grasped by the user. If the user wants to use each hand individually at the same time, then a second handle 195 is substituted for two-handed handle 194.

If lat hold-down L is used, then main leg 202 is slidably inserted into front foot 22 of main frame 10, and pinned by tightening screw 34. The vertical height of pads 106 relative to the floor on which the set-up stands is adjustable by use of quick-release pin 110. In this manner the relationship between the user, pads 106, and handle 194, for example, can be fine-tuned by concurrently adjusting the "length" of main leg 202 relative to front foot 22.

Figure 8:
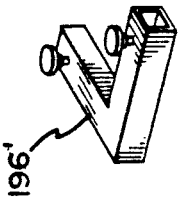
FIG. 8 is a view similar to FIG. 7 of an alternative embodiment of the coupling member.

Should space available for setting up cable crossover c be limited, then the two halves 174 and 176 of cable crossover 0 can be set up at substantially right angles (as shown in phantom line in FIG. 6) by use of L-shaped rigid coupling 196' (FIG. 8). Should additional stability be required or desired, then horizontal submember 70 can be inserted through and secured to one or more of front feet 22 and rear feet 24 (compare FIG. 4A) by tightening screw 34.

All materials used are preferably standard steel beams, channels, and members which are rigid and relatively strong. The pinned connections can be made with quick-release pins, nuts and bolts, straight pins, j-pins, or other fasteners.

While this invention has been described as having a preferred design, it is understood that it is capable of further modifications, uses and/or adaptations of the invention following in general the principle of the invention and including such departures from the present disclosure as come within the known or customary practice in the art to which to invention pertains and as may be applied to the central features hereinbefore set forth, and fall within the scope of the invention and of the limits of the appended claims.

I claim:

1. A universal-use knock-down weight-lifting frame having vertically and horizontally adjustable members, comprising:

a) a main frame having front and rear spaced opposed ends;

b) a front substantially vertical multifunction upright disposed at said front end of said main frame;

c) means disposed at said front end of said main frame for varying the vertical length of said front multifunction upright;

d) a front substantially horizontal support foot disposed at said front end of said main frame, said front substantially horizontal support foot being configured for carrying substantially vertical forces exerted on said main frame and for engaging a support surface;

e) means disposed at said front end of said main frame for varying the horizontal length of said front support foot;

f) a rear substantially vertical multifunction upright disposed at said rear end of said main frame;

g) means disposed at said rear end of said main frame for varying the vertical length of said rear multifunction upright;

h) a rear substantially horizontal support foot disposed at a lowermost portion of said rear end of said main frame, said rear substantially horizontal support foot being configured for carrying substantially vertical forces exerted on said main frame and for engaging a support surface; and i) means disposed at said rear end of said main frame for varying the horizontal length of said rear support foot.

2. A universal-use knock-down frame as defined in claim 1, wherein:

a) said front multifunction upright has a longer vertical length than said rear multifunction upright.

3. A universal-use knock-down frame as defined in claim 1, wherein:

a) said main frame includes a substantially horizontal lower cross brace extending between and attached to said front and rear multifunction uprights.

4. A universal-use knock-down frame as defined in claim 3, wherein:

a) said main frame includes a substantially horizontal upper cross brace extending between and attached to said front and rear multifunction uprights; and b) said upper cross substantially parallel to said lower cross brace.

5. A universal-use knock-down frame as defined in claim 1, wherein:

a) said means for varying the vertical length of said front multifunction upright includes a front submember movable relative to said front multifunction upright; and b) said means for varying the vertical length of said rear multifunction upright includes a rear substantially vertical submember movable relative to said rear multifunction upright.

6. A universal-use knock-down frame as defined in claim 5, wherein:

a) said rear multifunction upright includes a hollow tubular member;

b) said rear vertical submember is slidably received inside said hollow tubular member;

c) said means for varying the horizontal length of said front support foot includes a front substantially horizontal submember movable relative to said front support foot;

d) said means for varying the horizontal length of said rear support foot includes a rear substantially horizontal submember movable relative to said rear support foot;

e) said front multifunction upright includes a hollow tubular member; and f) said front submember is slidably received outside said hollow tubular member.

7. A universal-use knock-down frame as defined in claim 1, wherein:

a) a seat is detachably attached to said rear multifunction upright;

b) a leg hold is detachably attached to said front multifunction upright; and c) wherein, in use, an exerciser adjusts the vertical height of said front and rear multifunction uprights for adjusting the vertical height of said leg hold and said seat, and an exerciser performs a variety of exercises by sitting or lying on said seat and concurrently engaging said leg hold with his or her leg.

8. A universal-use knock-down frame as defined in claim 1, wherein:

a) a lat hold-down member is detachably attached to one of said front and rear support feet;

b) said lat hold-down member includes a substantially horizontal extension and a vertically adjustable leg hold; and c) wherein, in use, an exerciser adjusts the vertical distance between said leg hold and said horizontal extension, and an exerciser performs a variety of exercises while engaging said leg hold.

9. A universal-use knock-down frame as defined in claim 1, wherein:

a) an exercise bench is detachably attached to said front and rear multifunction uprights;

b) said exercise bench includes an angularly adjustable cushion, a leg extension device, and front and rear pivotally attached attachment members;

c) said front attachment member is detachably attached to said front multifunction upright;

d) said rear attachment member is detachably attached to said rear multifunction upright;

e) wherein, in use, an exerciser adjusts the vertical height of said front and rear multifunction uprights, the angle of said angularly adjustable cushion, and thereby exercising a variety of muscles.

10. A universal-use knock-down weight-lifting apparatus having vertically and horizontally adjustable members, comprising:

a) two main frames, each said main frame having front and rear spaced opposed ends;

b) a front substantially vertical multifunction upright disposed at said front end of each said main frame;

c) means disposed at said front end of each said main frame for varying the vertical length of said front multifunction upright;

d) a front support foot integrally attached to a lowermost portion of said front end of each said main frame, said front substantially horizontal support foot being configured for carrying substantially vertical forces exerted on said main frame and for engaging a support surface;

e) means disposed at said front end for varying the distance between said two main frames; and f) said distance varying means includes an auxiliary support foot disposed between and detachably attaching respective ones of said front support feet.

11. A universal-use knock-down apparatus as defined in claim 10, wherein:

a) each said front support foot includes a hollow tubular member; and b) said auxiliary support foot includes a substantially horizontal subelement slidably receivable in said hollow tubular members.

12. A universal-use knock-down apparatus as defined in claim 10, wherein:

a) a rear substantially vertical multifunction upright is disposed at said rear end of each said main frame;

b) means is disposed at said rear end of each said main frame for varying the vertical length of said rear multifunction c) a rear substantially horizontal support foot is disposed at said rear end of each said main frame; and d) means is disposed at said rear end of each said main frame for varying the horizontal length of said rear support foot.

13. A universal-use knock-down apparatus as defined in claim 12, wherein:

a) a substantially horizontal load-bearing safety support bar having front and rear ends is detachably attached to each of said two main frames;

b) each said safety support bar extends between and is attached to said front and rear multifunction uprights of respective said main frames;

c) each said safety support bar includes a vertically extending extension having means for engaging and mating with said rear multifunction upright;

d) each said safety support bar includes an open tubular member disposed at said front end thereof, said open tubular member surrounding and mating with said front multifunction upright; and e) a shock-absorbing member is disposed on each said safety support bar.

14. A universal-use knock-down exercise apparatus system configuration for a variety of exercises, comprising:

a) a main frame having front and rear spaced opposed ends;

b) a front substantially vertical multifunction upright disposed at said front end of said main frame;

c) means disposed at said front end of said main frame for varying the vertical length of said front multifunction upright;

d) a front substantially horizontal support foot disposed at a lowermost portion of said front end of said main frame;

e) means disposed at said front end of said main frame for varying the horizontal length of said front support foot; and f) an auxiliary exercise device detachably attached to said main frame.

15. A universal-use knock-down exercise apparatus system as defined in claim 14, wherein:

a) said auxiliary exercise device includes a second main frame and a cable crossover; and b) said cable crossover includes:

i) a cable-actuated weight system disposed thereon;

ii) first and second halves; and iii) means disposed on said crossover for connecting said first and second halves for orienting said first half parallel to said second half in a first configuration, and for orienting said first half transverse to said second half in a second configuration.

16. A universal-use knock-down exercise apparatus system as defined in claim 14, wherein:

a) said auxiliary exercise device includes:

i) a seat detachably attached to said rear multifunction upright;

ii) a leg hold detachably attached to said front multifunction upright; and iii) wherein, in use, an exerciser adjusts the vertical height of said front and rear multifunction uprights for adjusting the vertical height of said leg hold and said seat, and an exerciser performs a variety of exercises by sitting or lying on said seat and concurrently engaging said leg hold with his or her

17. A universal-use knock-down exercise apparatus system as defined in claim 14, wherein:

a) said auxiliary exercise device includes:

i) a lat hold down member detachably attached to one of said front and rear support feet;

ii) a substantially horizontal extension and a vertically adjustable leg hold disposed on said lat hold down member; and iii) wherein, in use, an exerciser adjusts the vertical distance between said leg hold and said horizontal extension, and an exerciser performs a variety of exercises while engaging said

18. A universal-use knock-down exercise apparatus system as defined in claim 17, wherein:

a) a vertically and horizontally adjustable seat support is detachably attached to said lat hold down member.

19. A universal-use knock-down exercise apparatus system as defined in claim 14, wherein:

a) an exercise bench is detachably attached to said front and rear multifunction uprights;

b) said exercise bench includes an angularly adjustable cushion, a leg extension device, and front and rear pivotally attached attachment members;

c) said front attachment member is detachably attached to said front multifunction upright;

d) said rear attachment member is detachably attached to said rear safety upright; and e) wherein, in use, an exerciser adjusts the vertical height of said front and rear multifunction uprights, the angle of said angularly adjustable cushion, and thereby exercising a variety of muscles.

20. A universal-use knock-down weight-lifting apparatus having vertically and horizontally adjustable members, comprising:

a) two substantially identical rigid planar frames, each said frame having front and rear spaced opposed ends;

b) a front substantially vertical multifunction upright disposed at said front end of each said frame;

c) means disposed at said front end of each said frame for varying the vertical length of said front multifunction upright;

d) a front element integrally attached to a lowermost portion of and extending substantially transversely to said front end of each said frame, said front element being configured for carrying substantially vertical forces exerted on said frame and for engaging a support surface;

e) means disposed at said front end for varying the distance between said two frames; and f) said distance varying means includes an auxiliary member disposed between and detachably attaching respective ones of said front elements.

21. A universal-use knock-down apparatus as defined in claim 20, wherein:

a) each said front element includes a hollow tubular member; and b) said auxiliary member includes a substantially horizontal subelement slidably receivable in said hollow tubular members.

22. A universal-use knock-down apparatus as defined in claim 20, wherein:

a) a rear substantially vertical multifunction upright is disposed at said rear end of each said main frame;

b) means is disposed at said rear end of each said main frame for varying the vertical length of said rear multifunction upright;

c) a rear substantially horizontal element is disposed at said rear end of each said main frame; and d) means is disposed at said rear end of each said main frame for varying the horizontal length of said rear element.

* * * * *